US011078869B2

(12) United States Patent
Marko

(10) Patent No.: US 11,078,869 B2
(45) Date of Patent: Aug. 3, 2021

(54) CONDENSING STIRLING CYCLE HEAT ENGINE

(71) Applicant: Matthew David Marko, Seaside Heights, NJ (US)

(72) Inventor: Matthew David Marko, Seaside Heights, NJ (US)

( * ) Notice: Subject to any disclaimer, the term of this patent is extended or adjusted under 35 U.S.C. 154(b) by 126 days.

(21) Appl. No.: 15/260,353

(22) Filed: Sep. 9, 2016

(65) Prior Publication Data

US 2016/0377024 A1 Dec. 29, 2016

(51) Int. Cl.
*F02G 1/043* (2006.01)

(52) U.S. Cl.
CPC ..... *F02G 1/043* (2013.01); *F02G 2243/30* (2013.01); *F02G 2250/00* (2013.01)

(58) Field of Classification Search
CPC ... F02G 1/043; F02G 2243/30; F02G 2250/00
See application file for complete search history.

(56) References Cited

U.S. PATENT DOCUMENTS 3,830,059 A * 8/1974 Spriggs ..... F02G 1/043 60/520
7,069,726 B2 * 7/2006 Frutschi ..... F01K 21/04 60/39.181
7,392,796 B2 * 7/2008 Adelshin ..... F01N 3/037 123/568.11
7,395,666 B2 * 7/2008 Miroslav ..... F02G 1/043 60/517
2009/0314005 A1 * 12/2009 Messmer ..... F02F 1/4292 60/792
2011/0000206 A1 * 1/2011 Aprad ..... F02G 1/043 60/517
2017/0167303 A1 * 6/2017 Olivotti ..... F01K 7/36
2018/0023465 A1 * 1/2018 Jackson ..... F02B 33/20 123/70 V

* cited by examiner

*Primary Examiner* — Michael C Zarroli

(57) ABSTRACT

The inventor claims a heat engine that follows a modification of the Stirling thermodynamic heat engine cycle; the monatomic working fluid is a saturated gas at the beginning of the isothermal compression stage, and ends up a mixed-phase fluid at the end of the compression. A proximate piston compresses and expands surrounding ideal gas helium, to function as a regeneration mechanism of this Stirling cycle and minimize the temperature difference during heat transfer. This cycle takes advantage of the temperature-dependent attractive intermolecular forces of the working fluid to assist in compressing the working fluid partially into a liquid, reducing the input compression work and increasing the overall heat engine efficiency.

6 Claims, 8 Drawing Sheets

The condensing Stirling Cycle Engine, Stage 2, where the working fluid argon is at the low temperature of 120 K, and the piston is at Top Dead Center. The argon is a mixed phase liquid-gas mixture, with a quality of 10%.

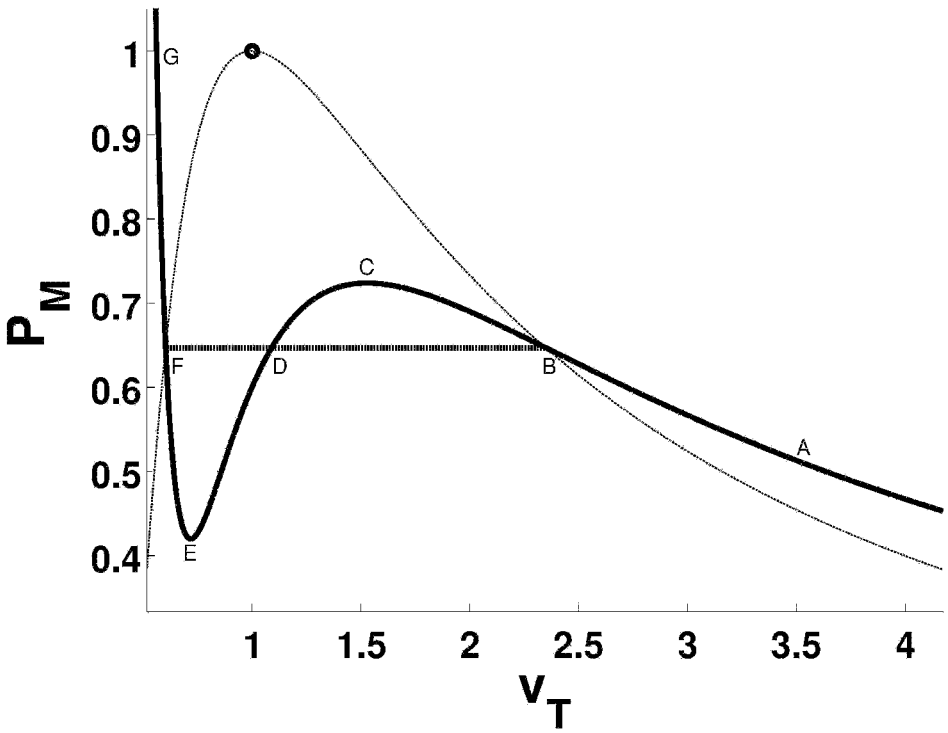
Figure 1: The labile Van der Waal isotherm (solid line), and the stable Maxwell's Construction (thick dashed curve), for a reduced temperature $T_R = 0.90$. The thin line represents the phase change as determined with Maxwell's construction for a reduced VDW equation of state.

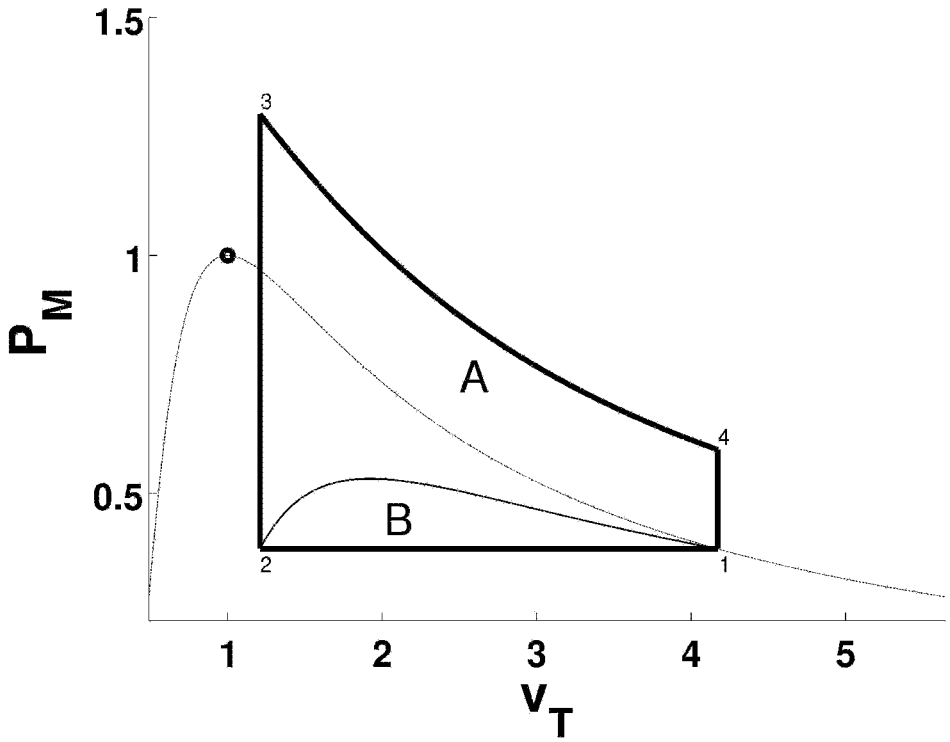
Figure 2: The Pv diagram of this modified Stirling cycle heat engine, for a low reduced temperature of $T_R = 0.8$, and a high reduced temperature of $T_R = 1.1$. The thin line represents the phase change as determined with Maxwell's construction for a reduced VDW equation of state.

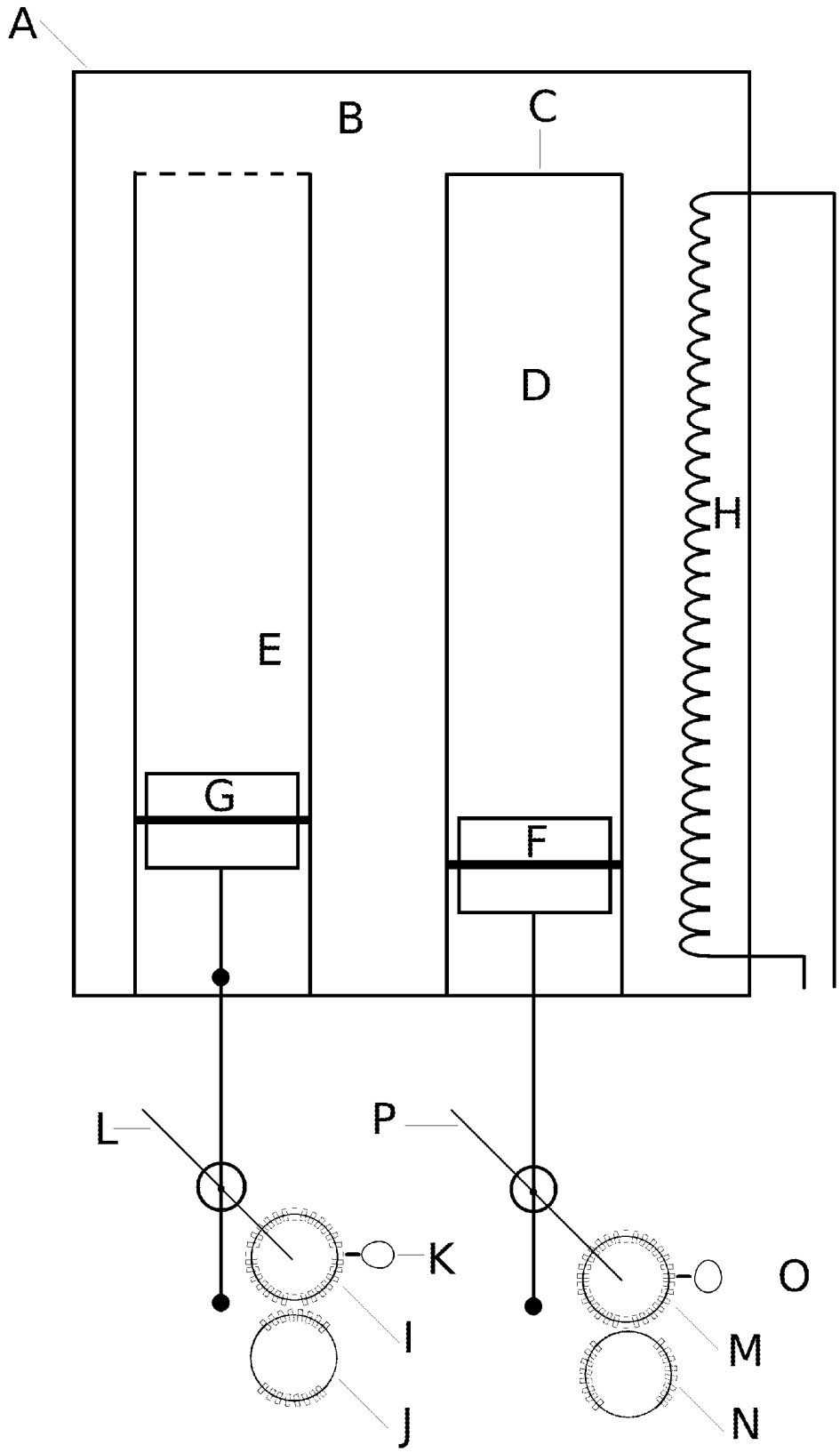
Figure 3: The condensing Stirling Cycle Engine, Stage 1, where the working fluid argon is at the low temperature of 120 K, and the piston is at Bottom Dead Center. The argon is a saturated gas at this stage.

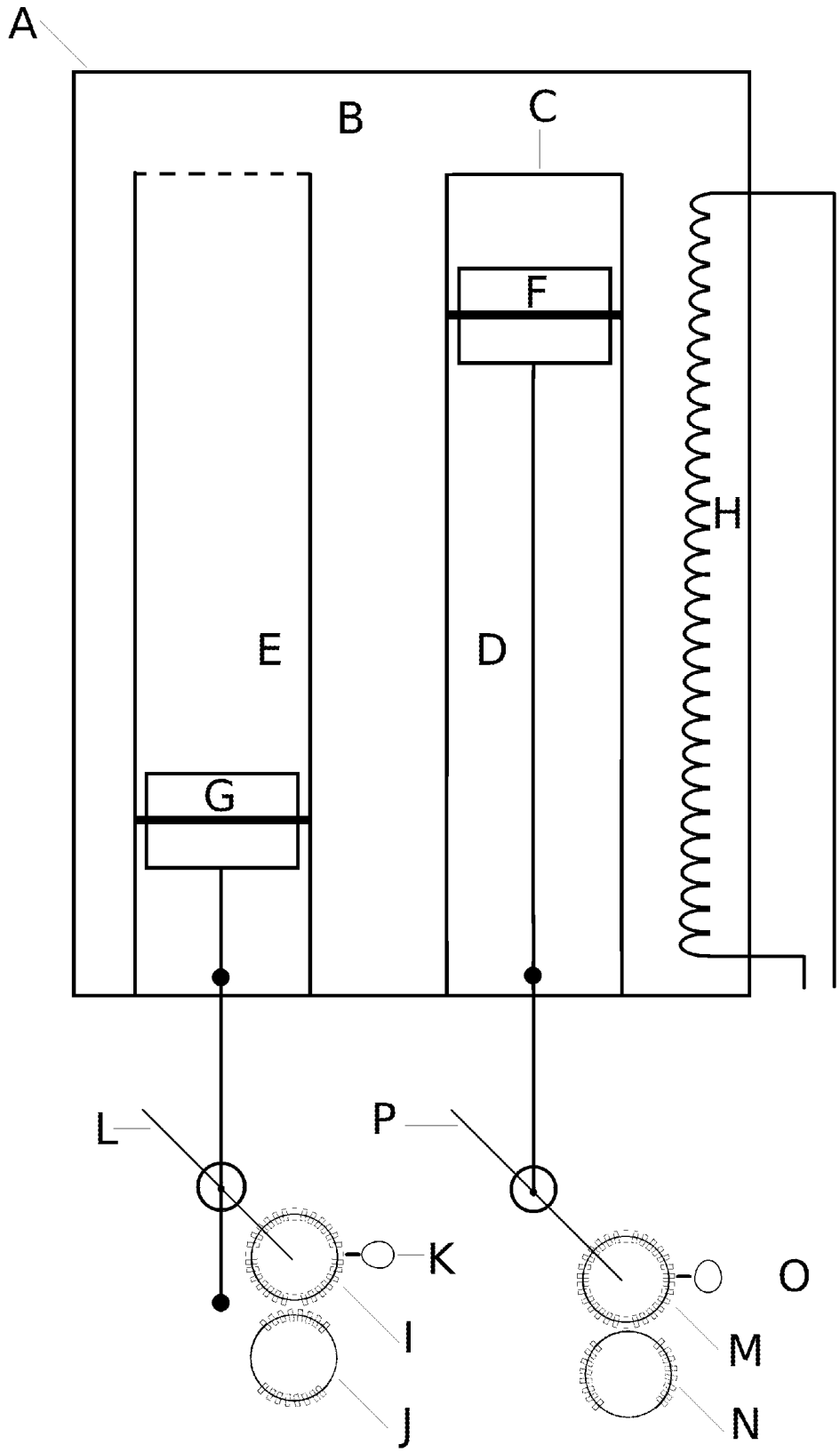
Figure 4: The condensing Stirling Cycle Engine, Stage 2, where the working fluid argon is at the low temperature of 120 K, and the piston is at Top Dead Center. The argon is a mixed phase liquid-gas mixture, with a quality of 10%.

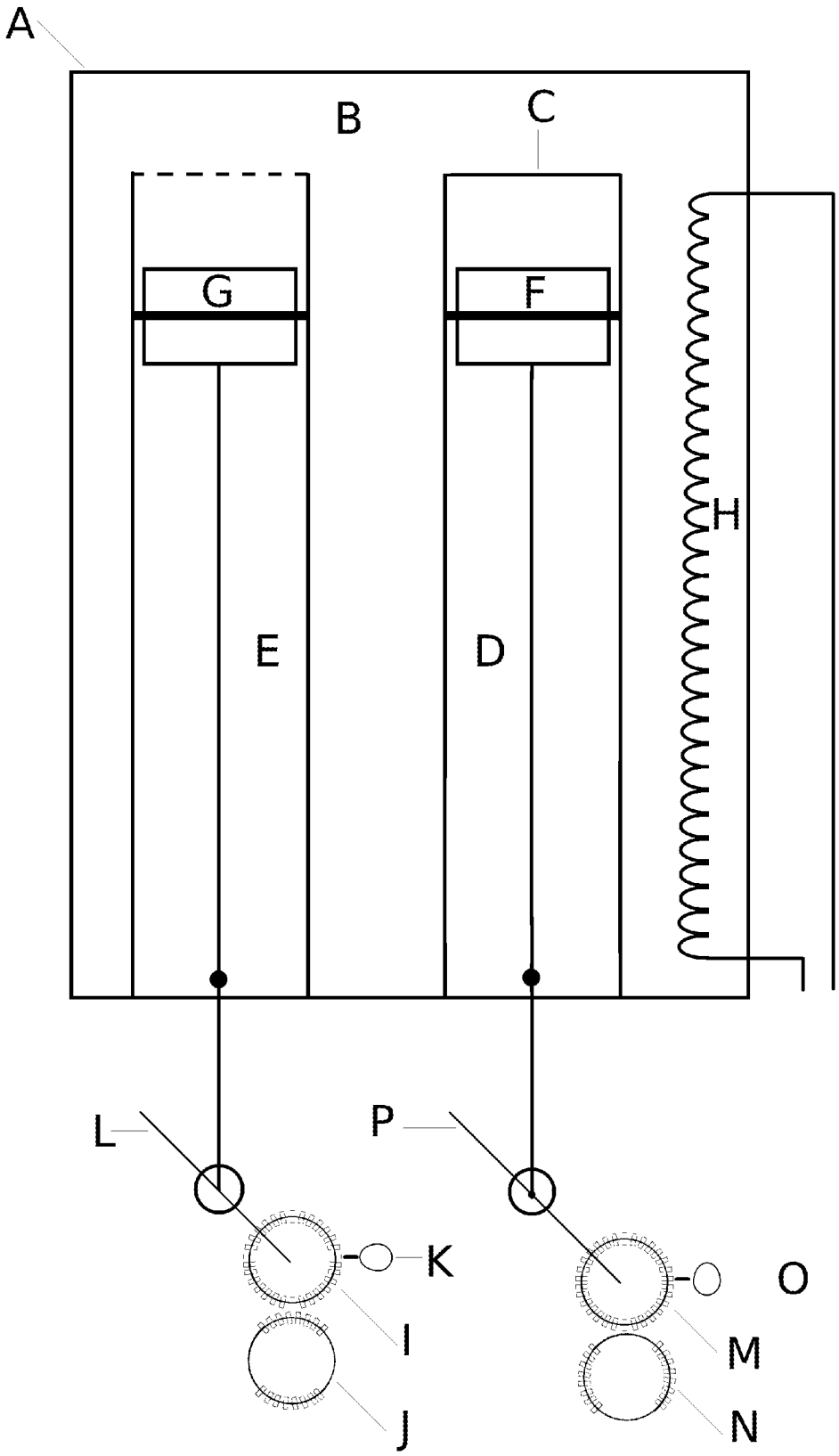
Figure 5: The condensing Stirling Cycle Engine, Stage 3, where the working fluid argon is at the high temperature of 166 K, and the piston is at Top Dead Center. The argon is a super-critical gas under very high pressure.

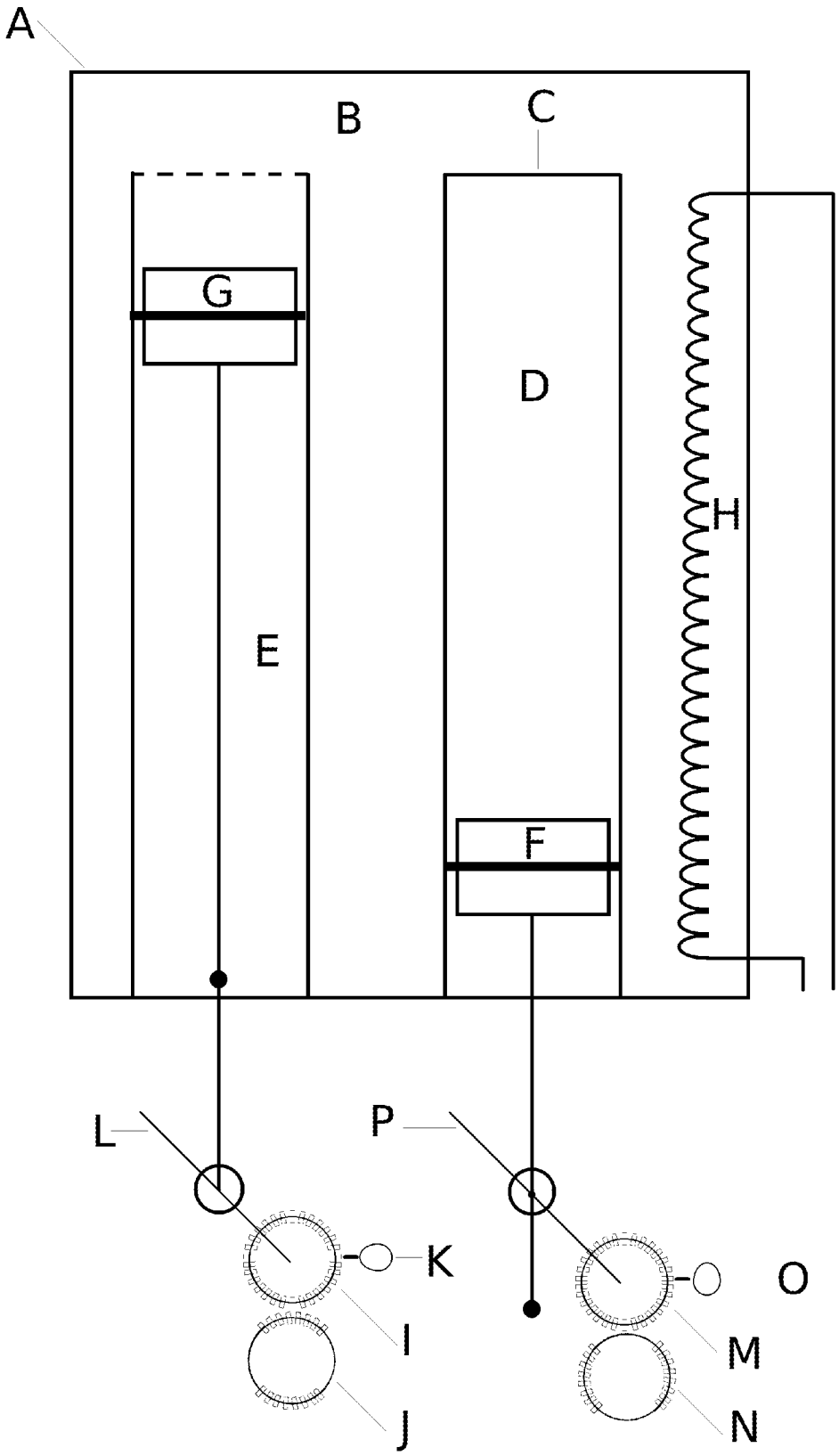
Figure 6: The condensing Stirling Cycle Engine, Stage 4, where the working fluid argon is at the high temperature of 166 K, and the piston is at Bottom Dead Center. The argon is a super-critical gas under moderate pressure.

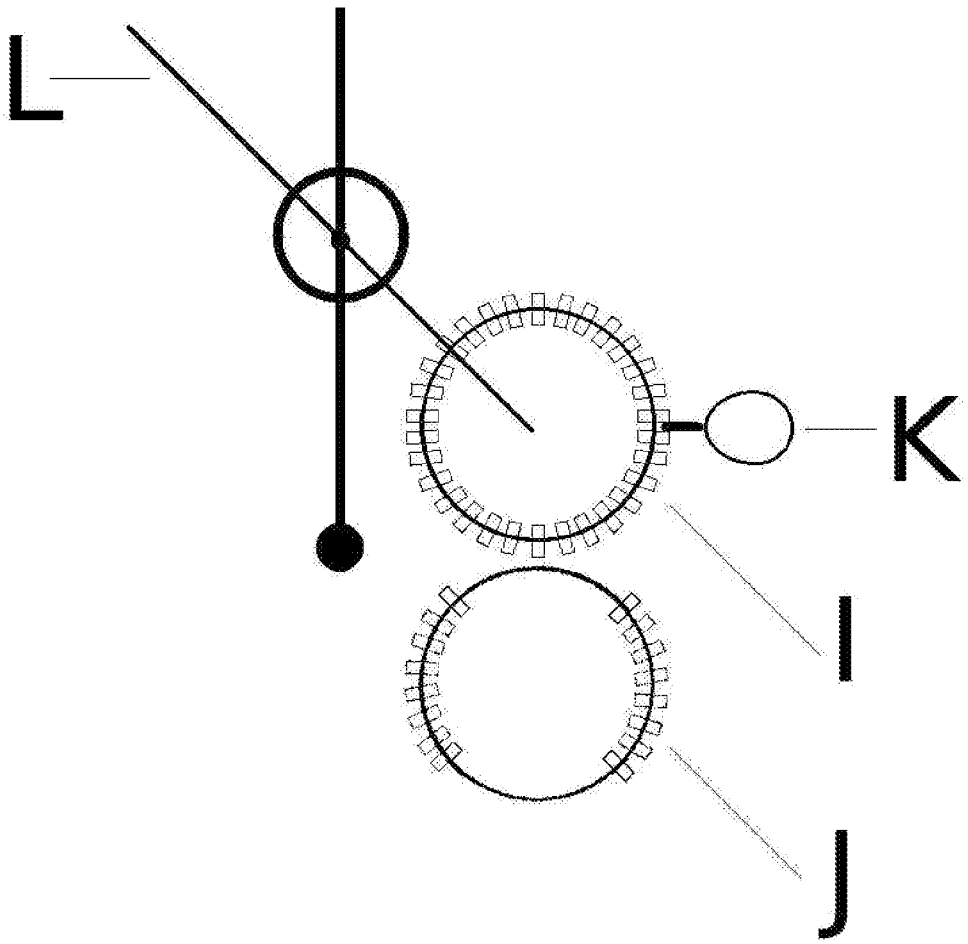

Figure 7: The gear system to operate the ideal-gas temperature adjusting piston. The mechanism is identical to the condensing Stirling Cycle engine; substitute Part *I* for *M*, Part *J* for *N*, Part *K* for *O*, and Part *L* for *P*. This piston is to remain fixed during this 90° range, so the mutilated gear has no tooths, and the cam system pushes a plunger up, to fix the gear in place. This cam system prevents the gear from flowing open during this stage.

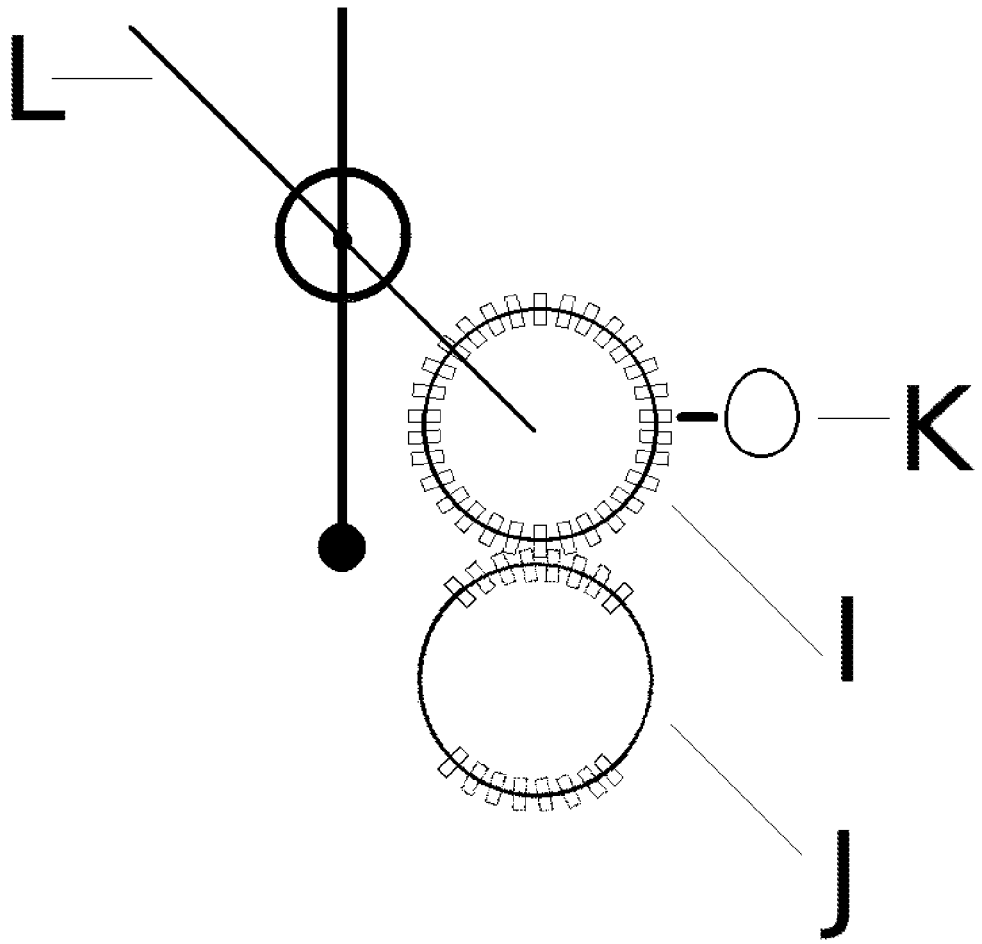

Figure 8: The gear system to operate the ideal-gas temperature adjusting piston. The mechanism is identical to the condensing Stirling Cycle engine; substitute Part $I$ for $M$, Part $J$ for $N$, Part $K$ for $O$, and Part $L$ for $P$. This piston is to move during this 90° range, so the mutilated gear has tooths, and the cam system is depressed allowing the gear to freely spin.

CONDENSING STIRLING CYCLE HEAT ENGINE

BACKGROUND OF THE INVENTION

From well before recorded human history, man has quested for different sources of energy for survival and comfort. Today, the need for useful energy plays a role in almost all aspects of society. Certainly, there is a benefit to having an efficient source of mechanical energy. When designing an engine, heat pump, or other thermodynamic cycle, one can not get around the laws of thermodynamics. Prevalent is the first law, which stipulates the conservation of energy; no energy can be created or destroyed. The second law is a result of the fact that heat can only flow from hot to cold, and not cold to hot; as a result, heat transfer processes ultimately result in thermodynamic disorder known as entropy throughout the universe. These two natural limitations have to be recognized in the design of a thermodynamic machine to achieve a net mechanical work output.

Under dense, pressurized conditions, a fluid ceases to become an ideal gas, and becomes a real gas following its equation of state. At a certain point, the intermolecular attractive forces of the fluid causes the gas to condense to a liquid, where these forces are too much for the kinetic energy of the fluid molecules to overcome, and the particles converge into a more ordered liquid state. During condensation, the fluid exists at two distinct phases at a constant temperature and pressure until it is a single consistent phase. As the pressure is constant with reduced volume during condensation, the intermolecular forces will reduce the work input during condensation from a saturated gas to a mixed-phase fluid.

BRIEF SUMMARY OF THE INVENTION

The inventor proposes a closed-loop, internally reversible, piston-cylinder heat engine, not dissimilar to the Stirling cycle. Rather than use an ideal gas, this cycle uses a real fluid that partially condenses during the isothermal compression stage of the cycle. The isothermal compression phase starts off as a saturated gas, and compresses isothermally at the cool temperature until a percentage of the gas has condensed. It then is heated to the hot temperature isochorically, at a temperature greater than the critical temperature. Afterwards, it expands isothermally back to the original saturated gas volume, recovering energy in the process. Finally, the gas is cooled isochorically back to the original stage pressure and temperature, where it is a saturated gas.

The engine takes advantage of the fluid's intermolecular attractive forces that enable the fluid to condense into a liquid. The impact of these forces is profound during condensation when the fluid is stable as two distinct phases of liquid and gas, as described by Maxwell's Construction. These forces keep the pressure consistent throughout condensation, rather than increasing with reduced volume as would be described during the equation of state; this ultimately results in less work input to compressed the gas isothermally, and thus greater efficiency of the heat engine.

BRIEF DESCRIPTION OF THE FIGURES

FIG. 1 The labile Van der Waal isotherm (solid line), and the stable Maxwell's Construction (thick dashed curve), for a reduced temperature $T_R$=0.90. The thin line represents the phase change as determined with Maxwell's construction for a reduced VDW equation of state.

FIG. 2 The Pv diagram of this modified Stirling cycle heat engine, for a low reduced temperature of $T_R$=0.8, and a high reduced temperature of $T_R$=1.1. The thin line represents the phase change as determined with Maxwell's construction for a reduced VDW equation of state.

FIG. 3 The condensing Stirling Cycle Engine, Stage 1, where the working fluid argon is at the low temperature of 120 K, and the piston is at Bottom Dead Center. The argon is a saturated gas at this stage.

FIG. 4 The condensing Stirling Cycle Engine, Stage 2, where the working fluid argon is at the low temperature of 120 K, and the piston is at Top Dead Center. The argon is a mixed phase liquid-gas mixture, with a quality of 10%.

FIG. 5 The condensing Stirling Cycle Engine, Stage 3, where the working fluid argon is at the high temperature of 166 K, and the piston is at Top Dead Center. The argon is a super-critical gas under very high pressure.

FIG. 6 The condensing Stirling Cycle Engine, Stage 4, where the working fluid argon is at the high temperature of 166 K, and the piston is at Bottom Dead Center. The argon is a super-critical gas under moderate pressure.

FIG. 7 The gear system to operate the ideal-gas temperature adjusting piston. The mechanism is identical to the condensing Stirling Cycle engine; substitute Part I for M, Part J for N, Part K for O, and Part L for P. This piston is to remain fixed during this 90° range, so the mutilated gear has no tooths, and the cam system pushes a plunger up, to fix the gear in place. This cam system prevents the gear from flowing open during this stage.

FIG. 8 The gear system to operate the ideal-gas temperature adjusting piston. The mechanism is identical to the condensing Stirling Cycle engine; substitute Part I for M, Part J for N, Part K for O, and Part L for P. This piston is to move during this 90° range, so the mutilated gear has tooths, and the cam system is depressed allowing the gear to freely spin.

HEAT PUMP COMPONENTS

List of labeled components in FIGS. 3-8:

(A) A pressure vessel that holds an ideal gas, which by expanding and compressing will adjust the overall temperature; this example has a maximum volume compression ratio of 2.375.

(B) An ideal gas working fluid, which is to provide heat transfer to and from the condensing Stirling cycle heat engine; this example is 1 kg of helium.

(C) The cylinder chamber for the condensing Stirling cycle heat engine; this example has a bore of 20 cm, a stroke of 40 cm, and a compression ratio of 6.81965.

(D) The condensing Stirling cycle heat engine working fluid; this example is a mass of 0.7575 kg of argon.

(E) The pressure vessel cylinder; the overall pressure vessel volume expands or decreases depending on the temperature of the condensing Stirling cycle heat engine.

(F) The piston for the condensing Stirling cycle heat engine.

(G) The pressure vessel piston; the piston position affects the overall volume and temperature of the ideal gas surrounding the condensing Stirling cycle heat engine.

(H) A heat exchanger for the supply fluid. During the transition from Stage 4 to Stage 2, a cold fluid at a near-constant temperature of 120 K flows through it. A valve system will direct a flow of a warmer fluid at a temperature of 166 K from Stage 2 until Stage 4.

(I) The gear that operates the pressure vessel volume piston (Part G).

(J) A mutilated gear of the same tooth size and dimensions as the gear for Part I. It has tooths in two evenly spaced sections of 90°, and no tooths for the remaining sections. It is synchronized so that there are tooths, and thus motion, for the isochoric heating Stage 23 and isochoric cooling Stage 41.

(K) A cam-shaft that is designed to activate an obstruction that locks the gear (Part I) in placed when the mutilated gear (Part J) is at a no-tooth angle. During these angles, the piston (Part G) remains fixed.

(L) The crank shaft that connects the piston (Part G) to the gear (Part I).

(M) The gear that operates the piston for the argon condensing Stirling cycle heat engine (Part F).

(N) A mutilated gear of the same tooth size and dimensions as the gear for Part M. It has tooths in two evenly spaced sections of 90°, and no tooths for the remaining sections. It is synchronized so that there are tooths, and thus motion, for the isothermal compression Stage 12 and isothermal expansion Stage 34.

(O) A cam-shaft that is designed to activate an obstruction that locks the gear (Part M) in placed when the mutilated gear (Part N) is at a no-tooth angle. During these angles, the piston (Part F) remains fixed.

(P) The crank shaft that connects the piston (Part F) to the gear (Part M).

DETAILED DESCRIPTION OF THE INVENTION

This heat engine is a modification of the Stirling cycle, a heat engine cycle of isothermal compression at the cold temperature sink, followed by isochoric heating up to the high temperature source, followed by isothermal expansion at the high temperature back to the original volume, and ending with isochoric cooling back to the original temperature and pressure. The original Stirling cycle operated under the assumption that the working fluid was constantly an ideal gas, where the equation of state is $$P\nu = RT, \tag{1}$$

where P (Pa) is the pressure, ν ($m^3$/kg) is the specific volume, T (K) is the absolute temperature, and R (J/kg·K) is the specific gas constant, where $$R = \frac{R_u}{M_m}, \tag{2}$$

where $M_m$ (kg/M) is the molar mass, and $R_u$ is the universal gas constant (8.314 J/M·K) defined as $$R_u = A \cdot \kappa, \tag{3}$$

where A is Avogadro's Number $6.02214.10^{23}$, and κ is Boltzman's Constant $1.38.10^{-23}$ (J/K). The number of moles M is defined as the total number of particles over Avogadro's Number $$M = \frac{N}{A}. \tag{4}$$

One aspect of this engine is that it does not use an ideal gas as the working fluid, but a real gas that is subjected to condensation and evaporation. The hot temperature of the engine is above the critical temperature $T_c$ (K), whereas the cold temperature of the engine is below the critical temperature, but above the triple point temperature $T_{tp}$ (K). The working fluid is a saturated gas at the initial, low temperature, high volume stage of the engine cycle. The working fluid partially condenses during the isothermal compression, which ends when the working fluid is a liquid-gas mixture. The working fluid is then heated isochorically to the hot temperature, upon which there is isothermal expansion back to the original stage volume, and where mechanical work is recovered. Finally, the working fluid undergoes isochoric cooling back to a saturated gas at the cool temperature, and the cycle repeats itself.

As the density of a fluid increases to the point of being a saturated liquid, saturated gas, or supercritical fluid, intermolecular attractive (and repulsive) forces can impact the pressure and temperature of the fluid. As the molecules get closer together in the presence of attractive intermolecular forces, the internal potential energy will decrease. The thermodynamic data yields an empirical equation that closely predicts the change in specific internal energy Δu (J/kg) during isothermal compression and expansion $$\Delta u = \frac{a'}{\sqrt{T}} \cdot \left(\frac{1}{v_1} - \frac{1}{v_2}\right), \tag{5}$$

$$a' = \frac{R^2 \cdot T_c^{2.5}}{9 \cdot \left(2^{\frac{1}{3}} - 1\right) \cdot P_c}.$$

where $\nu_1$ and $\nu_2$ ($m^3$/kg) represent the specific volume, T represents the temperature, R (J/kg·K) represents the gas constant, $T_C$ (K) represents the critical temperature, and $P_C$ (Pa) represents the critical pressure. The value of α' happens to be the same coefficient used in the Redlich-Kwong equation of state; equation 5 does not actually use any equation of state, as it is an empirical equation based on published data by NIST in the literature.

The condensing Stirling cycle heat engine described so far has been a theoretical cycle following a reduced VDW equation of state. The real engine that the inventor claims is a piston-cylinder system with the monatomic fluid argon; the engine cycle can work with any monatomic fluid if sized and designed accordingly. Argon was selected because helium and neon have extremely low critical temperatures of 5 K and 44 K; this cycle utilizes a cold temperature sink colder than the critical temperature. The heavier monatomic fluids of Krypton, Xenon, and Radon have higher critical temperatures of 209 K, 289 K, and 377 K, but their expense and rarity would make them infeasible to be a practical working fluid in this engine. For this reason, argon was selected as the best practical working fluid.

In addition, while the VDW equation of state is often a reasonable representation of molecular behavior, it is still fairly inaccurate when compared to experimental measurements. There are numerous equations of states for different molecules, and they are constantly evolving to better fit new experimental data. For the purpose of this design, the tables in *Thermodynamic Properties of Argon from the Triple Point to* 1200 *K with Pressures to* 1000 *MPa* by Stewart and Jacobsen 1989 (DOI: 10.1063/1.555829) will be used.

To best represent the theoretical condensing Stirling cycle heat engine demonstrated in FIG. 2, with a low reduced temperature of $T_R$=0.8 and a high reduced temperature of $T_R$=1.1, argon will be used with a low temperature $T_L$ of 120 K, and a high temperature $T_H$ of 166 K; the critical temperature of argon is 150.6633 K. At the critical point, the pressure 4.860 MPa, and the density is 13.29 mol/dm$^3$; with a molar mass of 39.948 g/mol, the density can be converted to 530.9 kg/m$^3$.

At Stage 1 of this cycle, the fluid is a saturated gas at the low temperature of 120 K; according to the referenced tables, the pressure is 1.2139 MPa, and the saturated liquid and gas densities are 29.1230 mol/dm$^3$ and 1.5090 mol/dm$^3$. The densities can easily be converted to the specific volumes, which are 0.8595.10$^{-3}$ m$^3$/kg and 16.5888.10$^{-3}$ m$^3$/kg for saturated liquid and gas argon at 120 K. This engine will compress the fluid to a quality $\chi$ of 10%, and therefore the volume is $$\begin{aligned} v_2 &= \chi \cdot v_{gas} + (1-\chi)\cdot v_{liquid} \\ &= (0.1\cdot 16.5888\cdot 10^{-3}) + (0.9\cdot 0.8595\cdot 10^{-3}) \\ &= 2.4325\cdot 10^{-3}. \end{aligned}$$

This corresponds to a density of 10.2910 mol/dm$^3$.

The hot, super-critical portion of the engine cycle will occur at a consistent temperature of 166 K, as the specific volume expands isothermally from 2.4325.10$^{-3}$ m$^3$/kg to the 120 K saturated gas specific volume of 16.5888.10$^{-3}$ m$^3$/kg. Referencing Table 1, the pressures and densities at 166 K can be determined, and the work output during isothermal expansion is calculated with numerical summation.

$$\begin{aligned} W_{34} &= \sum_{n=2}^{8} \frac{(P_n + P_{n-1})}{2}\cdot(v_n - v_{n-1}) \\ &= -48.8763 \text{ (kJ/kg)}. \end{aligned}$$

The work input during isothermal compression with condensation is more easily calculated, as due to Maxwell's Construction, the pressure remains constant, $$\begin{aligned} W_{12} &= P_{12}\cdot(v_1 - v_2) \\ &= 1.2139\cdot(16.5888 - 2.4325) \\ &= 17.1844 \text{ (kJ/kg)}, \end{aligned}$$

and thus the net mechanical work out of this engine per unit mass of working fluid for each cycle is −31.6919 kJ/kg.

TABLE 1

Table of Argon at 166 K. The values for data point 1 were determined by interpolation between the values of data point 2 and *; likewise the values for data point 8 were determined by interpolation between the values of data point 7 and x.

| i | P (MPa) | Density (mol/dm$^3$) | v · 10$^{-3}$ (m$^3$/kg) |
|---|---|---|---|
| * | 1.5 | 1.1822 | 21.1745 |
| 1 | 1.8669 | 1.5090 | 16.5888 |
| 2 | 2.0000 | 1.6275 | 15.3810 |
| 3 | 2.5000 | 2.1058 | 11.8874 |
| 4 | 3.0000 | 2.6235 | 9.5417 |
| 5 | 4.0000 | 3.8140 | 6.5633 |

TABLE 1-continued

Table of Argon at 166 K. The values for data point 1 were determined by interpolation between the values of data point 2 and *; likewise the values for data point 8 were determined by interpolation between the values of data point 7 and x.

| i | P (MPa) | Density (mol/dm$^3$) | v · 10$^{-3}$ (m$^3$/kg) |
|---|---|---|---|
| 6 | 5.0000 | 5.3102 | 4.7140 |
| 7 | 6.0000 | 7.3273 | 3.4163 |
| 8 | 6.9007 | 10.2910 | 2.4325 |
| x | 8 | 13.9080 | 1.7999 |

It is now possible to characterize the pressure, temperature, specific volume, internal energy, and enthalpy of the condensing Stirling cycle heat engine with argon. The pressures are determined from the referenced tables; the pressure of condensation for T=120K of $P_1$=$P_2$=1.2139 MPa, and the interpolated super-critical pressures of $P_3$=6.9007 MPa and $P_4$=1.8689 MPa. The temperatures are by design, with $T_1$=$T_2$=120 K and $T_3$=$T_4$=166 K. The specific volumes are designed by the piston and cylinder, with the Top Dead Center volume of $v_2$=$v_3$=2.4325.10$^{-3}$ (m$^3$/kg), and the Bottom Dead Center volume of $v_1$=$v_4$=16.5888.10$^{-3}$ (m$^3$/kg). The internal energy u and enthalpy h are determined from the kinetic gas theory and the integration of equation 5, which for a monatomic fluid such as argon, $$u = \frac{3}{2}\cdot R\cdot T - \frac{a'}{\sqrt{T}}\cdot\frac{1}{v},$$

$$a' = \frac{R^2.T_c^{2.5}}{9\cdot\left(2^{\frac{1}{3}}-1\right)\cdot P_c}.$$

$$h = \frac{5}{2}\cdot P\cdot P_v.$$

and thus the results can be found in Table 2.

Next, the first law of thermodynamics is used to determine the heat input and output at each stage. The work applied during isothermal compression and expansion has

TABLE 2

Table of Argon Pressure P, Temperature T, specific volume v, internal energy u, and enthalpy h.

| P (MPa) | T (K) | v · 10$^{-3}$ (m$^3$/kg) | u (kJ/kg) | h (kJ/kg) |
|---|---|---|---|---|
| 1.2139 | 120 | 16.5888 | 31.6202 | 51.7574 |
| 1.2139 | 120 | 2.4325 | -64.5863 | -61.6335 |
| 6.9007 | 166 | 2.4325 | 17.9512 | 34.7370 |
| 1.8669 | 166 | 16.5888 | 46.8554 | 77.8258 |

been determined, and the heat input is simply the summation of the change in internal energy minus the work applied by the fluid $$Q_{ij}=\delta u_{ij}+W_{ij}, \tag{6}$$

and thus using the internal energies in Table 2, the net heat inputs and outputs can be determined and included in Table 3. The summation of the heat and work in Table 3 is zero, $$\Sigma_{ij}(Q+W)_{ij}=-113.3909+82.5375+77.7806-15.2352+17.1844-48.8764=0,$$

showing that this cycle is an internally reversible cycle that complies with the first law of thermodynamics.

TABLE 3

Table of heat and work inputs and outputs at each stage of the argon condensing Stirling cycle heat engine.

| — | 12 | 23 | 34 | 41 |
|---|---|---|---|---|
| Q (kJ/kg) | −113.3909 | 82.5375 | 77.7806 | −15.2352 |
| W (kJ/kg) | 17.1844 | 0 | −48.8764 | 0 |

Finally, the efficiency η of this engine $$\eta = \frac{W_{net}}{Q_{in}},$$

can be determined from the values in Table 3

$$\eta = -\frac{W_{12} + W_{34}}{Q_{23} + Q_{34}} = \frac{48.8764 - 17.1844}{82.5375 + 77.7806} = \frac{31.6920}{160.3181} = 0.1977.$$

If there is perfect regeneration of the heat output from the isochoric cooling (41) into the heat input from the isochoric heating (23), the efficiency is improved $$\eta_{regen} = -\frac{W_{12} + W_{34}}{Q_{23} + Q_{34} + Q_{41}} = \frac{48.8764 - 17.1844}{82.5375 + 77.7806 - 15.2352} = \frac{31.6920}{145.0829} = 0.2184.$$

An example of this engine cycle being practically implemented is represented in FIGS. 3-8. The engine is a sealed piston, of 20 cm bore and 40 cm stroke, and filled with 0.7575 kg of argon. This piston is surrounded by an ideal gas under pressure in a sealed pressure vessel, and the heat exchanger supplies both heating and cooling fluids to the surrounding ideal at the temperatures of 120 K and 166 K. The heat transfer of the argon filled piston shall be efficient enough that the temperature of the argon will be nearly identical to the temperature of the surrounding gas.

The pressure vessel volume can expand and contract by an isentropic piston; this piston recovers mechanical energy during expansion and inputs mechanical energy during compression. During the isochoric heating of the argon, the volume of the surrounding ideal gas will compress slowly so that the ideal gas will heat up slowly, and the temperature difference during heat transfer will be minimized, reducing the overall entropy of heat transfer of the engine cycle. A mechanical work input will be used during this compression; this work will be recovered when the piston expands while the argon is undergoing isochoric cooling.

For the practical implementation of the argon engine described, 1 kg of helium will be used as the surrounding heat transfer fluid; helium has a specific heat ratio of 5/3 and a gas constant of 2,078 J/kg·K. The pressure vessel can be of an arbitrary volume; for the given mass, decreasing the volume will result in an increase in pressures, but not affecting the work inputs and outputs. For 1 kg of helium, 0.7575 kg of argon, and a temperature range between 120 K and 166 K, the ideal gas volume decreases by a factor of 2.375, and the work input for each compression stroke would be 155 kilojoules. This compression will serve to raise the temperature from 120 K to 166 K, and allow for sufficient heat loss to heat the argon simultaneously. This energy is recovered during the argon cooling stage, where the piston expands and recovers this energy. By using this method, reducing the temperature difference significantly during heat transfer, the ideal engine efficiency (excluding friction and irreversible losses) can get closer to the 21.84% possible with this engine cycle.

The pistons are synchronized, so that the ideal gas piston is fixed when the argon engine piston is in motion, and vice versa. During the isothermal compression of the argon, the heat input into the ideal gas is removed by the heat exchanger fluid (at 120 K), and the ideal gas piston remains fixed at Bottom Dead Center. During the isochoric heating, the heat exchanger fluid ceases to flow, the argon piston is held fixed, and the ideal gas piston compresses the gas to Top Dead Center. For the isothermal expansion of the argon, the ideal gas piston remains fixed at Top Dead Center, and the heat exchanger fluid flowing provides a source of heat at 166 K. Finally, the argon gas is held fixed by the piston, while the gas cools to saturation; during this time, the ideal gas piston is expanding back to Bottom Dead Center and recovering mechanical energy.

To synchronize these two pistons, each piston is controlled by a gear, which is operated by a mutilated gear. These two mutilated gears have teeth on half of the circumference, divided into four 90° sections of gear-teeth and no-gear-teeth. These gears are connected to a cam-shaft, that operates a brake that holds the piston fixed in place during the no-gear-teeth angles; without this feature, the pressurized ideal and argon gas will expand against the piston prematurely. FIG. 7 represents the no-gear-teeth angles, when the piston is locked in place. FIG. 8 represents the gear-teeth angles, where the cam shaft releases the brake, and the piston is free to move. Both the ideal gas piston and the argon piston are connected to the same constant-speed crank-shaft where mechanical energy is recovered from the heat engine; the two pistons are offset by 90° so that the two pistons are not in motion at the same time.

This cycle can run at varying speed so long as it is slow enough to ensure sufficient heat transfer at each stage. The greater and more consistent the heat transfer, the less entropy will generate and thus the efficiency of the heat engine will increase. With sufficient heat transfer, and a temperature source and sink of 120 K and 166 K, heat engine efficiencies up to the 21.84% possible with this engine cycle can be achieved by taking advantage of the attractive intermolecular forces during condensation.

What I claim is:

1. A method of operating a mechanical heat engine according to an internally reversible, thermodynamic cycle, comprising:

providing saturated argon gas at 120 K in a piston-cylinder system at bottom dead center;

isothermally compressing the argon at 120 K in the piston cylinder system to top dead center;

isochorically heating the argon in the piston cylinder system fixed at top dead center to a supercritical gas at 166 K temperature;

isothermally expanding the gas in the piston cylinder system at 166 K back to bottom dead center; and isochorically cooling the argon in the piston-cylinder system fixed at bottom dead center to a saturated gas at 120 K.

2. The method of claim 1, wherein the mechanical heat engine is surrounded by a 1 kg mass of ideal gas helium disposed proximate the piston cylinder system, to serve as a heat transfer medium from a heat exchanger;

during the process of isothermal expansion, this will provide a heating source at 166 K;

followed by providing a heat sink at 120 K for cooling the process of isothermal compression.

3. The mechanical heat engine method as described in claim 1 wherein the engine further comprises;

a bore of 20 cm, a stroke of 40 cm, a compression ratio of 6.82 and a steel cylinder wall of 5 mm thickness, and containing 0.7575 kg of argon.

4. The mechanical heat engine method of claim 3, wherein the cyclic motion moves for 90°, and then stops;

the heat engine piston-cylinder system is allowed to move from bottom dead center to top dead center during isothermal compression;

the heat engine piston-cylinder system is held motionless during isochoric heating; the heat engine piston-cylinder system is allowed to move from top dead center to bottom dead center during isothermal expansion;

the heat engine piston-cylinder system is held motionless during isochoric cooling; the motion control is actuated by a mechanical obstruction operated by a cam shaft.

5. The method of claim 2, wherein the ideal gas helium average temperature is increased and decreased between 120 K and 166 K by compressing the 1 kg helium with a second piston-cylinder system;

providing the ideal gas helium at a temperature of 120 K at bottom dead center; providing the ideal gas helium at a temperature of 166 K at top dead center;

and with a compression ratio of 2.375.

6. The method of claim 5, wherein the cyclic motion moves for 90°, and then stops;

the heat engine piston-cylinder system is held motionless during isothermal compression; the heat engine piston-cylinder system is allowed to move from bottom dead center to top dead center during isochoric heating;

the heat engine piston-cylinder system is held motionless during isothermal expansion;

the heat engine piston-cylinder system is allowed to move from top dead center to bottom dead center during isochoric cooling; the motion control is actuated by a mechanical obstruction operated by a cam shaft.

* * * * *